United States Patent [19]

Badaud

[11] Patent Number: 5,041,807

[45] Date of Patent: Aug. 20, 1991

[54] HIGH TENSION CONNECTION FOR AN IGNITION COIL, IN PARTICULAR FOR AN INTERNAL COMBUSTION ENGINE FOR AN AUTOMOTIVE VEHICLE

[75] Inventor: Eric Badaud, Saint-Remy sur Durolle, France

[73] Assignee: Valeo Electronique, Voisins-le-Bretonneux, France

[21] Appl. No.: 582,090

[22] Filed: Sep. 14, 1990

[30] Foreign Application Priority Data

Sep. 15, 1989 [FR] France ..... 89 12087

[51] Int. Cl.[5] ..... H01F 27/04

[52] U.S. Cl. ..... 336/92; 336/96; 336/105; 336/192; 336/212

[58] Field of Search ..... 439/841, 843; 336/90, 336/92, 96, 105, 107, 192, 212, 198, 208; 123/634

[56] References Cited

U.S. PATENT DOCUMENTS 2,447,376 8/1948 Tognola ..... 336/92
4,509,033 4/1985 Weiss et al. ..... 336/107

FOREIGN PATENT DOCUMENTS 8518139 10/1986 Fed. Rep. of Germany .
2526992 11/1983 France .
803640 10/1958 United Kingdom .
975268 11/1964 United Kingdom .
2199193 6/1988 United Kingdom .

*Primary Examiner*—Thomas J. Kozma
*Attorney, Agent, or Firm*—Dennison, Meserole, Pollack & Scheiner

[57] ABSTRACT

An ignition coil, in particular for an internal combustion engine for an automotive vehicle, comprises, integrated into a housing, a magnetic assembly which includes a magnetic core mounted within a primary spool, with a secondary spool arranged coaxially around the primary spool. The spools carry the primary winding and the secondary winding, respectively, and the coil further includes a magnetic flux return circuit and a high tension connection assembly. The latter includes an insert member secured in the secondary spool, a high tension busing and a high tension guide member in which the high tension output member is mounted, and is characterized in that the high tension output member comprises a spring.

7 Claims, 2 Drawing Sheets

HIGH TENSION CONNECTION FOR AN IGNITION COIL, IN PARTICULAR FOR AN INTERNAL COMBUSTION ENGINE FOR AN AUTOMOTIVE VEHICLE

FIELD OF THE INVENTION

The present invention relates to an ignition coil, in particular for an internal combustion engine for an automotive vehicle.

BACKGROUND OF THE INVENTION

As is already known, the secondary of a typical ignition coil produces a very high voltage, such as to enable an electrical arc to be generated across the electrodes of the sparking plugs, thus igniting the fuel/air mixture contained in the cylinders in the engine block.

Commonly, one single coil controls all of the spark plugs via, for example, a mechanical distributor, generally of the kind having a rotating distributor arm. Such an installation has the drawback that it necessitates a bundle of high tension cables which connect the secondary of the ignition coil to the distributor, and the distributor to each of the spark plugs. Apart from the cost of this bundle of cables, the latter is subject to electrical losses, which give rise to parasitic radio-electric waves; this is quite acceptable when a mechanical distributor is used, but such waves interfere very significantly with the ignition system when this latter is of the kind that includes electronic modules in place of a mechanical distributor.

In order to overcome the above disadvantages, it has already been proposed to associate on ignition coil individually with each spark plug. The present invention is particularly applicable to such a coil (referred to here as a "single cylinder ignition coil") which includes a closed-circuit magnetic assembly comprising a central magnetic core, around which two spools of plastics material are arranged coaxially. The primary and secondary windings are wound on these spools, and the assembly so formed is integrated into a housing which is formed by moulding over it in plastics material. A synthetic resin is flowed into the interior of the housing so as to encapsulate the various components of the ignition coil and to insulate them electrically from each other.

One of the problems to be overcome in an ignition coil of this type is that of how to construct a high tension connecting means which is such as to enable the electrical connection between the end of the secondary winding and the corresponding spark plug to be achieved, and in particular the connection between the end of the secondary winding and the high tension output member which makes direct contact with the spark plug associated with the coil.

This output member commonly consists of a carbon brush which is held in contact with the end of the spark plug through a spring. Such a carbon brush is inevitably subject to wear and embrittlement, due in particular to the high temperatures to which it is subjected. In addition, its retention in its housing calls for more or less complex solutions which considerably add to the cost of the ignition coil.

SUMMARY OF THE INVENTION

An object of the present invention is to overcome these problems. To this end it proposes an ignition coil, in particular for an internal combustion engine for an automotive vehicle, comprising, integrated into a housing, a magnetic assembly which includes a magnetic core mounted within a primary spool, a secondary spool which is coaxial with the primary spool, a primary winding and a secondary winding, a magnetic flux return circuit constituting a metallic armature, and a high tension connection assembly which includes an insert member secured in the secondary spool, a high tension bushing and a high tension guide member in which the high tension output member is mounted, characterised in that the high tension output member comprises a spring.

In accordance with another aspect of the invention, the fastening of the various components of the high tension connecting assembly, and in particular the high tension output member, is obtained by means of the encapsulating resin itself, flowed into the interior of the housing.

The description which follows, which is given by way of example and with reference to the accompanying drawings in relation to a preferred embodiment of the invention, will afford a fuller understanding as to how the invention may be put into practice.

DESCRIPTION OF A PREFERRED EMBODIMENT OF THE INVENTION

Figure 1:
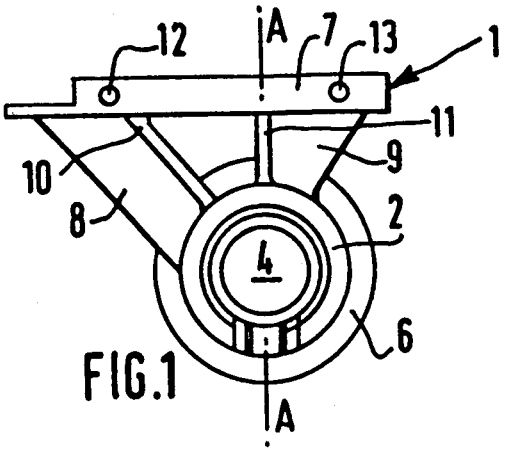
FIG. 1 is a plan view of a high tension bushing.
Figure 2:
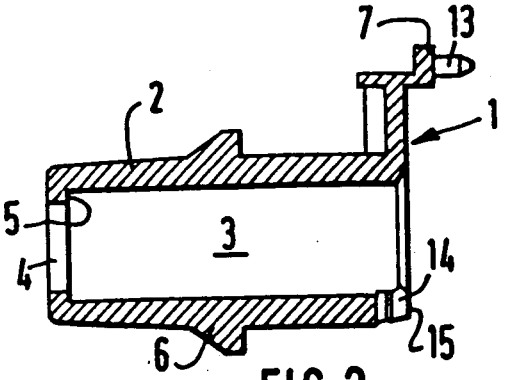
FIG. 2 is a cross sectional view taken on the line A—A in FIG. 1.
Figure 3:
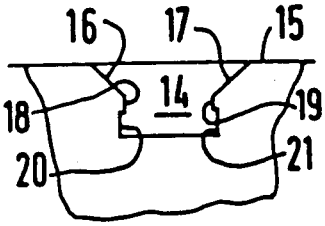
FIG. 3 is a partial view of the high tension bushing on a larger scale.

Reference is first made to FIGS. 1 to 3, which show a high tension bushing 1 which is moulded in an electrically insulating synthetic plastics material, such as PBT. The bushing 1 comprises a body 2, generally cylindrical in shape, having a cylindrical internal cavity 3 which is open at one end of the body through an opening 4, the diameter of which is smaller than that of the cavity 3 so as to define a shoulder 5 within the cavity 3. In its central region, the body 2 has an integral collar portion 6 which projects outwardly from the outer surface of the body 2. The end of the body 2 which is remote from the end in which the opening 4 is formed is joined to a securing bar 7 through two webs 8 and 9, which are reinforced by ribs 10 and 11 respectively. The securing bar 7 also includes two positioning pins 12 and 13.

The wall of the body 2 which lies radially opposite the securing bar 7 is formed with a recess 14, the shape of which is shown in FIG. 3 on a larger scale. This recess 14 is formed with an outer section which is convergent inwardly from the end face 15, and which is defined by walls 16 and 17; a first aperture defined by wall portions 18 and 19; and a second aperture defined by wall portions 20 and 21. The second aperture is wider than the first aperture.

Figure 4:
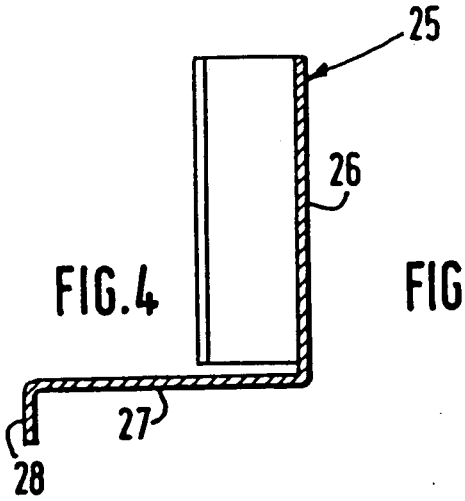
FIG. 4 is a view in cross section showing the high tension guide member, taken on the line B—B in FIG. 5.
Figure 5:
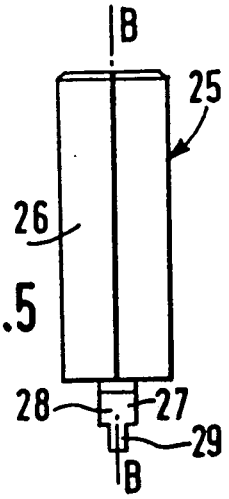
FIG. 5 is a view of the high tension guide member as seen from the left hand side of FIG. 4.
Figure 6:
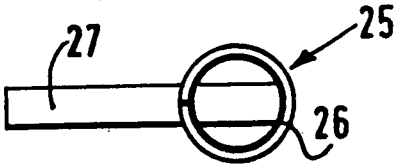
FIG. 6 is a plan view on the high tension guide member.

Reference is now made to FIGS. 4 to 6, which show a high tension guide member 25 which is made by cutting and stamping from a flat piece of conductive material, for example brass. The high tension guide member 25 is generally in the form of a tube 26, the wall of which is extended at one end in a horizontal tongue 27, which includes a vertical tab 28 having a free end portion 29 narrower than the remainder of the tongue 27.

Figure 8:
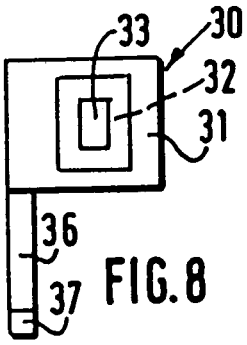
FIG. 8 is a view of the high tension insert member when seen in the direction of the arrow F1 in FIG. 7.
Figure 7:
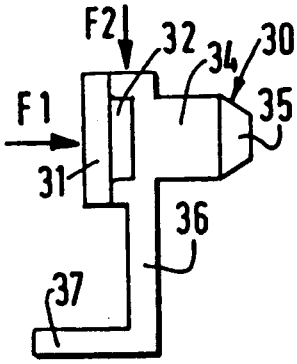
FIG. 7 is a view, seen in profile, of a high tension insert member.
Figure 9:
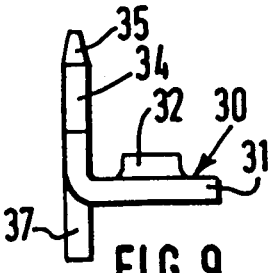
FIG. 9 is a view of the high tension insert member seen in the direction of the arrow F2 in FIG. 7.

FIGS. 7 to 9 show a high tension insert member 30, again made of a conductive metal such as brass. This insert member 30 includes a base portion 31, on one face of which a boss 32 is formed. A recess 33 is formed in the centre of the boss 32, FIG. 8. The base portion 31, the boss 32 and the recess 33 are all generally rectangular in shape. The base 31 is extended in a finger portion 34, the free end 35 of which is chamfered and of generally trapezoidal cross section. The base 31 is also extended in a tongue 36, the free end portion 37 of which is bent over at right angles. As is shown in FIG. 9, the end portion 37 is located at the opposite side of the base 31 from the finger portion 34.

Figure 10:
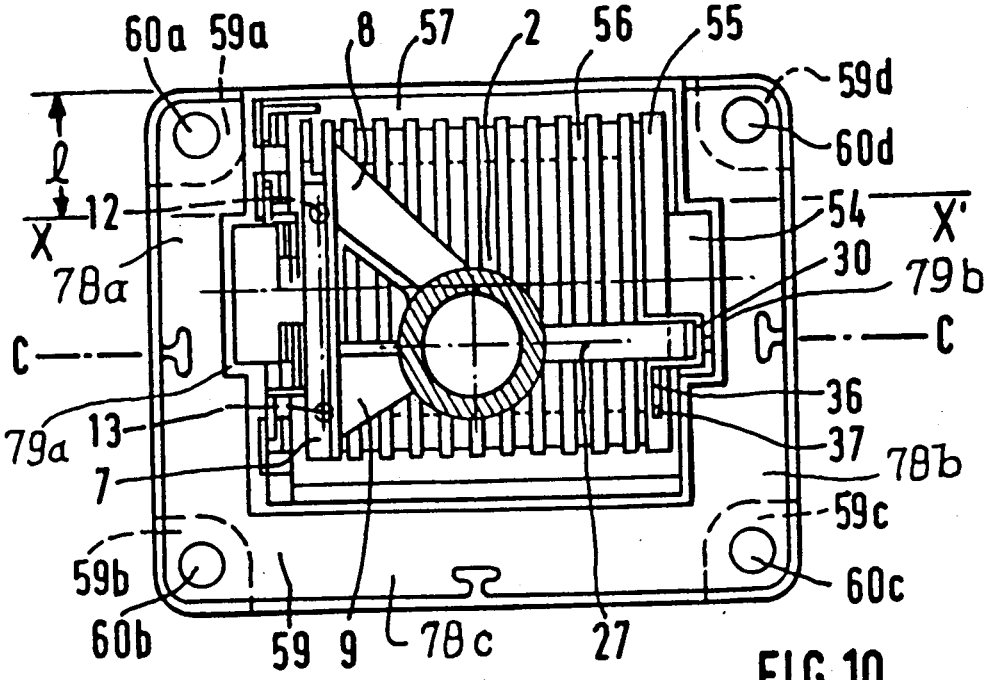
FIG. 10 is an inverted plan view on an ignition coil which is fully equipped in accordance with the invention.
Figure 11:
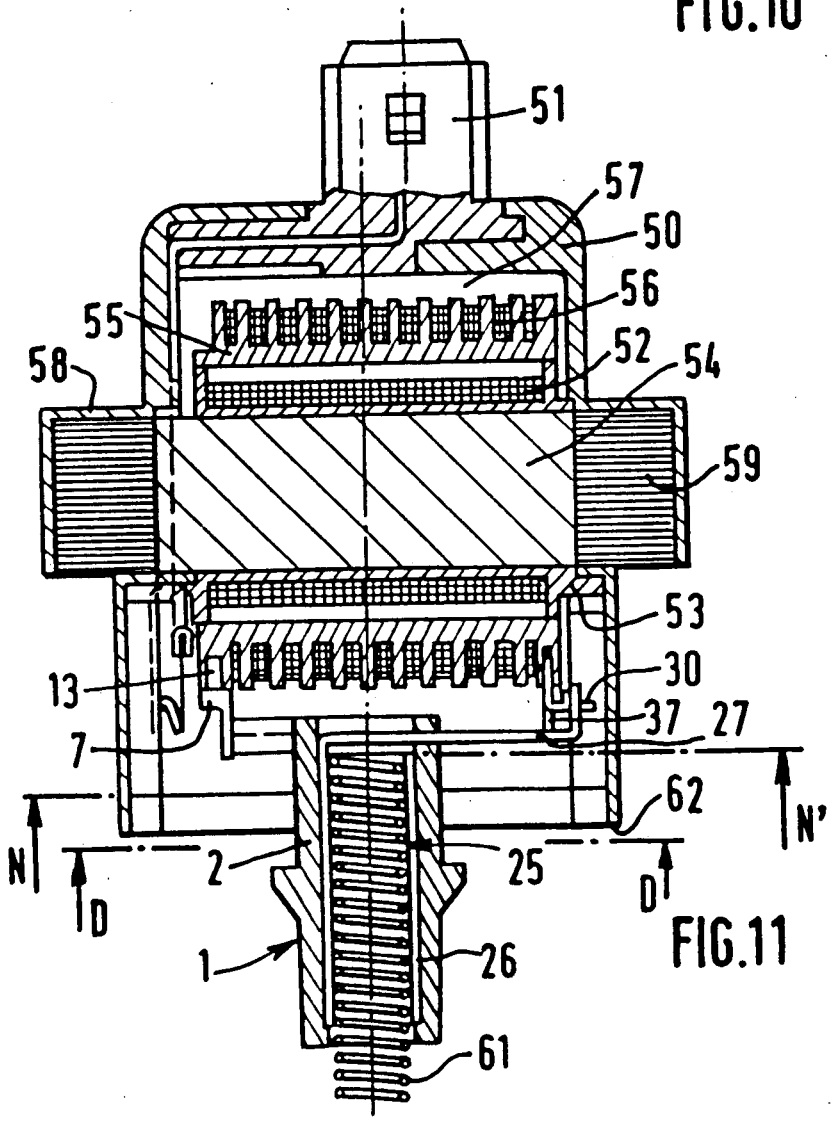
FIG. 11 is a view in cross section, taken on the line C—C in FIG. 10.

The high tension bushing 1, the high tension guide member 25, and the insert member 30 are all part of an assembly which constitutes the high tension connection of the single-cylinder ignition coil in accordance with the invention. FIGS. 10 and 11 show such a coil. It comprises a housing 50, which is applied by moulding, over the other components of the coil, in a suitable plastics material, and a connector 51 for the low tension electrical supply of the coil.

The magnetic circuit is a closed one, and comprises a primary winding 52, which is wound on a spool 53. A magnetic core 54, rectangular in cross section and formed generally of interleaved, pressed-out magnetic laminations, is mounted within the spool 53. Around this assembly, and coaxially with the primary spool 53, there is arranged a secondary spool 55 around which is wound a secondary winding 56. The secondary spool 55 is supported on and around the primary spool 53.

The high tension insert member 30 described above is introduced, by means of the free end 35 of its finger portion 34, into an opening which is provided for this purpose in the secondary spool 55. The end of the secondary winding 56 is soldered on to the free end portion 37 of the tongue 36 of the insert member 30. When an assembly has thus been constructed, consisting mainly of the primary spool 53 and secondary spool 55, this assembly is introduced into the cavity 57 defined in the hollow interior of the housing 50.

A magnetic flux return circuit 59, the general shape of which is seen to be U-shaped, and which consists of pressed-out and interleaved magnetic laminations, is incorporated by moulding in the housing 50. This magnetic flux return circuit 59 constitutes the metallic armature of the housing 50, together with the base by means of which the coil assembly is secured to the engine block. This magnetic circuit 59 comprises three orthogonal members **78*a*, 78*b*, 78*c***, arranged in pairs to form, in U-shaped section, three sides of a rectangle.

After moulding of the circuit 59 into the housing 50, only the surfaces **79*a* and 79*b* of recesses formed in the branches 78*a* and 78*b* of the U section of the magnetic flux return circuit 59 are exposed. These surfaces 79*a* and 79*b* are of a generally rectangular shape and lie facing toward the ends of the central magnetic core 54**.

Currently, in coils of this type, the branches **78*a* and 78*b* of the U section constituting the magnetic flux return circuit 59 do not extend beyond the central magnetic core 54, that is to say their terminal ends are located as indicated by the line X—X′ shown in FIG. 11**. In practice, such an arrangement satisfies the operating condition for correct functioning of the magnetic circuit assembly, and gives economy in material and thus in cost.

However, in the present case the branches **78*a* and 78*b* are extended by a length l beyond the line X—X′ corresponding to one of the faces of the central magnetic core 54. The magnetic flux return circuit 59, and thus the housing 50 into which it is moulded, therefore completely enclose the secondary spool 55**, and thus also the primary magnetic assembly P and the secondary magnetic assembly S.

In addition, this extension of the branches **78*a* and 78*b* offers an additional heat exchange surface, and therefore enables better cooling of the whole of the ignition coil to be achieved. This particular arrangement also enables the magnetic flux return circuit 59 to be given a generally rectangular contour in combination with the housing 50**; and this facilitates the fastening of the ignition coil assembly on to the engine block.

To this end, at the four corners of the rectangle defined on the upper face 58 of the armature, four rebates **59*a*, 59*b*, 59*c* and 59*d* are formed. Holes 60*a*, 60*b*, 60*c* and 60*d*, which are formed respectively in the centres of these rebates, extend through the housing 50 and the magnetic flux return circuit 59**, so as to receive fastening screws (not shown) for the whole of the coil.

The high tension connections are made prior to the operation of flowing a synthetic resin into the interior of the housing to encapsulate, immobilise and insulate the various components. This high tension connection assembly comprises a spring 61 which is introduced into the high tension guide member 25 until it comes into engagement against the tongue 27 of the latter (FIG. 4). The spring 61 also makes direct contact in this way with the spark plug associated with the coil, and so ensures transmission of the high tension voltage and constitutes the high tension output member.

The high tension guide member 25, equipped with the spring 61, is introduced into the cavity 3 of the high tension bushing 1, and is secured in the latter by a snap-fit of the tongue 27 of the guide member 25, in the second aperture of the bushing described above which is defined by the wall portions 20 and 21 (FIGS. 2 and 3) of the recess 14 in the bushing.

This high tension connection assembly is positioned as a unit in the housing 50 and on the secondary spool 55 which has previously been fitted. This positioning is obtained firstly by penetration of the pins 12 and 13 of the securing bar 7 of the bushing 1 in corresponding apertures which are provided for this purpose in the secondary spool 55; and secondly by penetration of the tip 29, of reduced thickness, of the end portion 28 of the guide member 25 into the recess 33 formed in the high tension insert member 30.

When the high tension assembly has been positioned in this way within the cavity 57 in the housing 50, the synthetic resin is applied so as to fill the latter up to a level indicated in FIG. 11 at N, which lies close to the level of the face 62 of the housing 50. It is arranged that this level N will always be higher than the level N' which corresponds to the terminal end of the spring 61 within the high tension guide member 25. Once cured, the resin immobilises all the components within the housing 50, and in particular the spring 61.

Using the spring 61, a high tension connection has thus been achieved which offers numerous advantages, for example reduced wear (there being no carbon brushes), vibration resistance and easy assembly.

It will be noted that, when the coil is fastened on the engine block, the face 62 of the housing 50, on which the encapsulating resin is exposed, lies facing downwards as can be seen in FIG. 11, and is thus naturally protected against damage.

What is claimed is:

1. An ignition coil for an internal combustion engine, comprising a housing, a magnetic assembly carried by the housing, and a high tension connecting assembly carried by the housing, the magnetic assembly including a primary spool, a secondary spool coaxial with the primary spool, a primary winding and a secondary winding wound respectively on said primary and secondary spools, a magnetic core mounted in the primary spool, and a magnetic flux return circuit constituting a metallic armature, wherein the high tension connection assembly includes an insert member secured in the secondary spool, a high tension bushing, a high tension guide member mounted in the bushing and connected to the insert member, a high tension output member in the form of a spring mounted in the guide member, and an encapsulating resin in the housing for encapsulating the components therein, wherein said resin constitutes securing means for said spring in the high tension guide member.

2. An ignition coil according to claim 1, further including positioning means for positioning the high tension connection assembly in the housing, wherein the high tension bushing includes a securing bar and a plurality of pins, constituting said positioning means, formed integrally with the securing bar.

3. An ignition coil according to claim 2, wherein the insert member defines a recess therein, the high tension guide member having a tongue formed with a tip of reduced thickness, said recess and tip cooperating with each other to constitute said positioning means for positioning the high tension connecting assembly in the housing.

4. An ignition coil according to claim 1, wherein the high tension bushing has a recess therein defining a snap-fitting means, and the high tension guide member has a tongue engaged by a snap-fit in said recess in the bushing, whereby said tongue and recess together constitute securing means for securing the high tension guide member in the high tension bushing.

5. An ignition coil according to claim 1, wherein said magnetic flux return circuit comprises at least three parts which are arranged orthogonally one to another so as to define a U-shaped section constituting three sides of a rectangle in which said magnetic flux return circuit is contained, and wherein said high tension output member is oriented in a direction intersecting the center of said rectangle.

6. An ignition coil according to claim 5, wherein the parts of the magnetic flux return circuit that constitute the branches of the U are extended in length with respect to the face of the central core.

7. An ignition coil according to claim 6, further comprising encapsulating resin flowed into the housing and securing the high tension output member in the high tension guide member.

* * * * *